US005471109A

United States Patent [19]

Gore et al.

[11] Patent Number: 5,471,109

[45] Date of Patent: Nov. 28, 1995

[54] METHOD AND APPARATUS FOR PREVENTING REVERSE FLOW IN AIR OR GAS COOLED LAMPS

[75] Inventors: Jayavant P. Gore, West Lafayette, Ind.; Robert J. Sweetman, Olney, Md.

[73] Assignee: Fusion Systems Corporation, Rockville, Md.

[21] Appl. No.: 999,133

[22] Filed: Dec. 31, 1992

[51] Int. Cl.[6] ..... H01J 7/24; F21V 7/20

[52] U.S. Cl. ..... 313/22; 313/35; 313/36; 362/345

[58] Field of Search ..... 313/12, 22, 35, 313/36; 315/39, 149, 151, 267; 362/345, 264, 294, 373; 165/104.33, 104.34

[56] References Cited

U.S. PATENT DOCUMENTS

| | | | |
|---|---|---|---|
| 3,792,230 | 2/1974 | Ray | 362/345 |
| 3,966,308 | 6/1976 | Nilson . | |
| 4,402,850 | 8/1977 | Ury et al. . | |
| 4,630,182 | 12/1986 | Moroi et al. | 362/345 |
| 4,659,757 | 9/1987 | Ury et al. | 313/44 |
| 4,990,789 | 2/1991 | Uesaki | 315/39 |
| 5,021,924 | 6/1991 | Kieda et al. | 165/104.33 |

*Primary Examiner*—Sandra L. O'Shea
*Assistant Examiner*—Vip Patel
*Attorney, Agent, or Firm*—Pollock, Vande Sande & Priddy

[57] ABSTRACT

A method and apparatus for preventing contaminated reverse flows in air or gas impingement cooled lamps. In an electrodeless lamp, a stream of clean air or gas is provided as a replacement for contaminated air.

7 Claims, 5 Drawing Sheets

METHOD AND APPARATUS FOR PREVENTING REVERSE FLOW IN AIR OR GAS COOLED LAMPS

FIELD OF THE INVENTION

The present invention is directed to a method and apparatus for preventing contamination of surfaces of lamps and other surfaces in the vicinity of streams of air or gas used for cooling the lamps.

BACKGROUND OF THE INVENTION

The invention is illustrated in connection with use in a microwave powered electrodeless lamp, and while it can be used with other types of air or gas cooled lamps, the invention finds particular application with electrodeless lamps. Specific examples of microwave powered lamps are disclosed in U.S. Pat. Nos. 3,872,349, 4,042,850, 4,695,757 and 4,485,332 which are incorporated herein by reference. The lamps find application in curing of ink, organic resins and in photolithography.

Briefly, the electrodeless lamps described in the above patents are comprised of a lamp bulb containing a plasma forming medium which is disposed in a microwave enclosure. During operation of the lamp the medium in the bulb is exposed to microwave or other electromagnetic radiation which is coupled to the microwave enclosure, thereby generating a plasma which emits Ultra Violet (UV), visible and infrared radiation. Typically, the microwave enclosure is comprised of a reflector and mesh. The reflector reflects the radiation which is emitted by the bulb out of the enclosure through the mesh, which is operative to contain the microwave energy. The radiation leaving the enclosure is incident upon the material being processed with the UV energy.

The radiation which is emitted by the lamp increases as a function of the input microwave energy thereby allowing high processing speeds. However, the lamp transfers a great deal of heat to the bulb during operation, and the performance is limited by the effectiveness of bulb cooling techniques. The cooling techniques involve high speed streams of air (in the current designs but other gases could easily be used) impinging on and flowing over the lamp bulb, and carrying heat away as their sensible energy.

It has been found that the cooling air streams, which have to be of high speed to provide adequate cooling for operation of the lamps at high power densities, cause complex transient flow patterns within the reflector cavity and outside it around the material being processed. It has been further discovered that the complex flow patterns include recirculation of air (or other cooling gas) from outside the lamp enclosure into it. This outside gas generally contains products of curing and lithography even in dust-free environment. The high speed jets have been found entrain these contaminants and deposit them on the lamp envelope and reflector surfaces fouling the latter and causing expensive downtime and replacement costs. The prior art solution to this problem has been to provide a quartz shield which reduces the light output and is only partially effective in preventing the reverse flows. Removal of the products of curing and photolithography by an outside flow of air has also been only marginally successful.

It is thus an object of the present invention to provide an improved method and apparatus for preventing the contamination and fouling of lamps which are created by complex recirculating flows caused by streams of cooling air or gas.

It is a further object of the invention to improve the lifetime of the lamp bulbs by eliminating fouling of their surfaces.

It has been found that the reverse flows are drawn into the lamp by regions of vacuum which are caused by entrainment of air or gas by the high speed cooling streams. In accordance with the invention, a source of clean air or gas is provided to satisfy the entrainment requirement of the high speed streams, thus resulting in the elimination of the reverse flows of contaminants.

The invention will be better understood by referring to the following drawings wherein:

DESCRIPTION OF THE PREFERRED EMBODIMENTS

Figure 1:
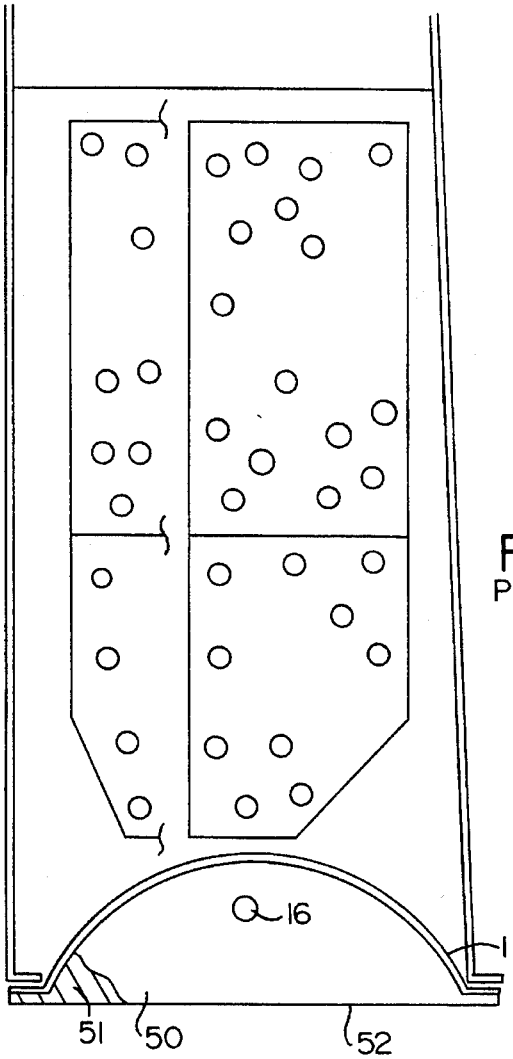
FIG. 1 PRIOR ART
FIG. 1 shows an end view of a microwave powered electrodeless lamp described by Ury et al. in U.S. Pat. No. 4,042,850.

Referring to FIG. 1, the light source which is depicted is comprised of a longitudinally extending lamp bulb 16 which is disposed in a longitudinally extending microwave enclosure comprised of elliptically shaped reflector 1, metallic end plates 50 and 51, and mesh screen 52. The long dimension of the bulb, reflector, and mesh screen is perpendicular to the plane of the paper, and the end plates lie in planes which are parallel to the plane of the paper. This is more clearly seen in FIGS. 2 and 3, which are perspective views of the lamp.

Figure 2:
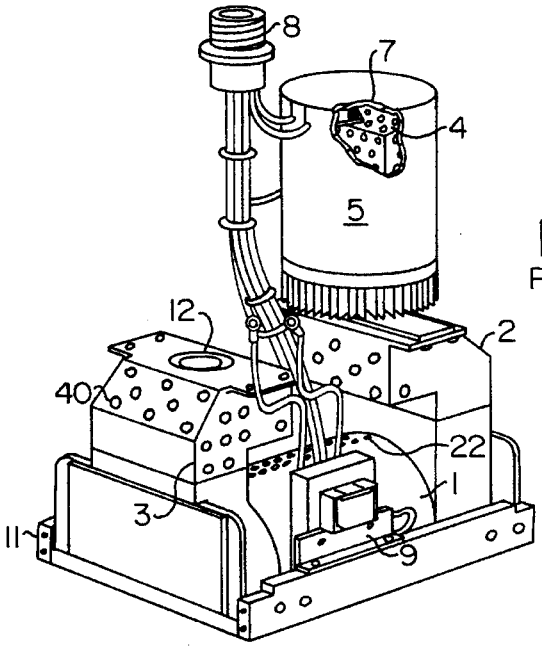
FIG. 2 PRIOR ART
FIGS. 2 and 3 show perspective views of the lamp of FIG. 1.
Figure 3:
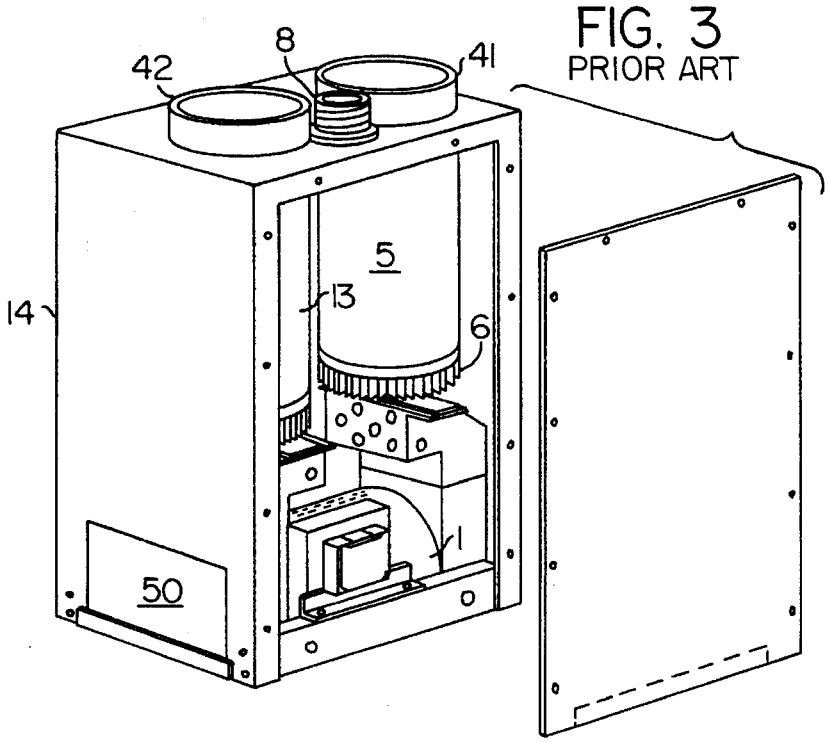
FIG. 3 PRIOR ART
Figure 4:
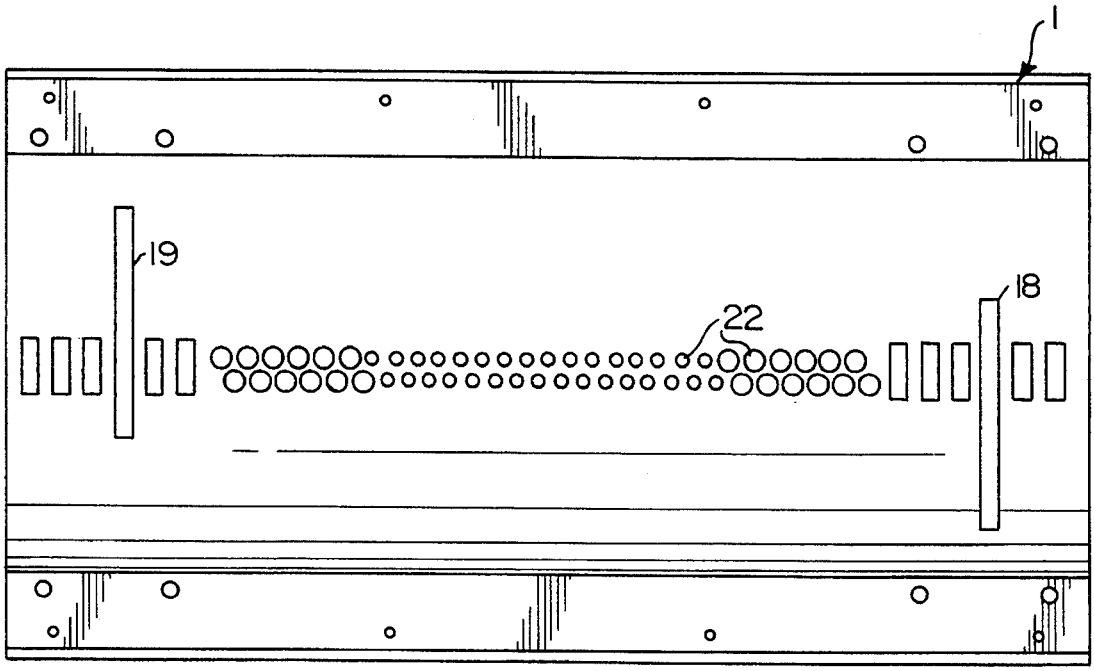
FIG. 4 PRIOR ART
FIG. 4 shows a plane view of the reflector which is used in the lamp of FIG. 1.

The lamp bulb is located at or approximately at the focus of the ellipse, and microwave power is generated by two magnetrons, each of which is mounted near a respective end of the chamber. In FIG. 2, only right end magnetron 4 is shown. The magnetrons are mounted on waveguides 2 and 3, and generate microwave energy which passes through slots at each end of the elliptical reflector, and is absorbed by the material in the bulb which then generates the desired light output. The light generated by the bulb leaves the light source through the wire mesh 52 with or without single and multiple reflections from the elliptical reflector. The microwaves are prevented from escaping the chamber by means of the wire mesh. In the preferred embodiment of the invention described in U.S. Pat. No. 4,042,850, the magnetrons are 1500 watt sources and the plasma load dissipates approximately 300 watts per linear inch as heat and light, with a large portion as heat. In order to prevent overheating of the bulb and the various parts, a compressed air source feeds ports 41 and 42. The air is utilized to cool the magnetrons, to cool the waveguides through a multitude of holes 40, and finally to cool the lamp bulb 1 through a multitude of holes 22 in the reflector. FIG. 4 shows the pattern of holes 22 in the reflector through which the compressed air flows. Slots 18 and 19 are for coupling microwave energy.

Figure 5:
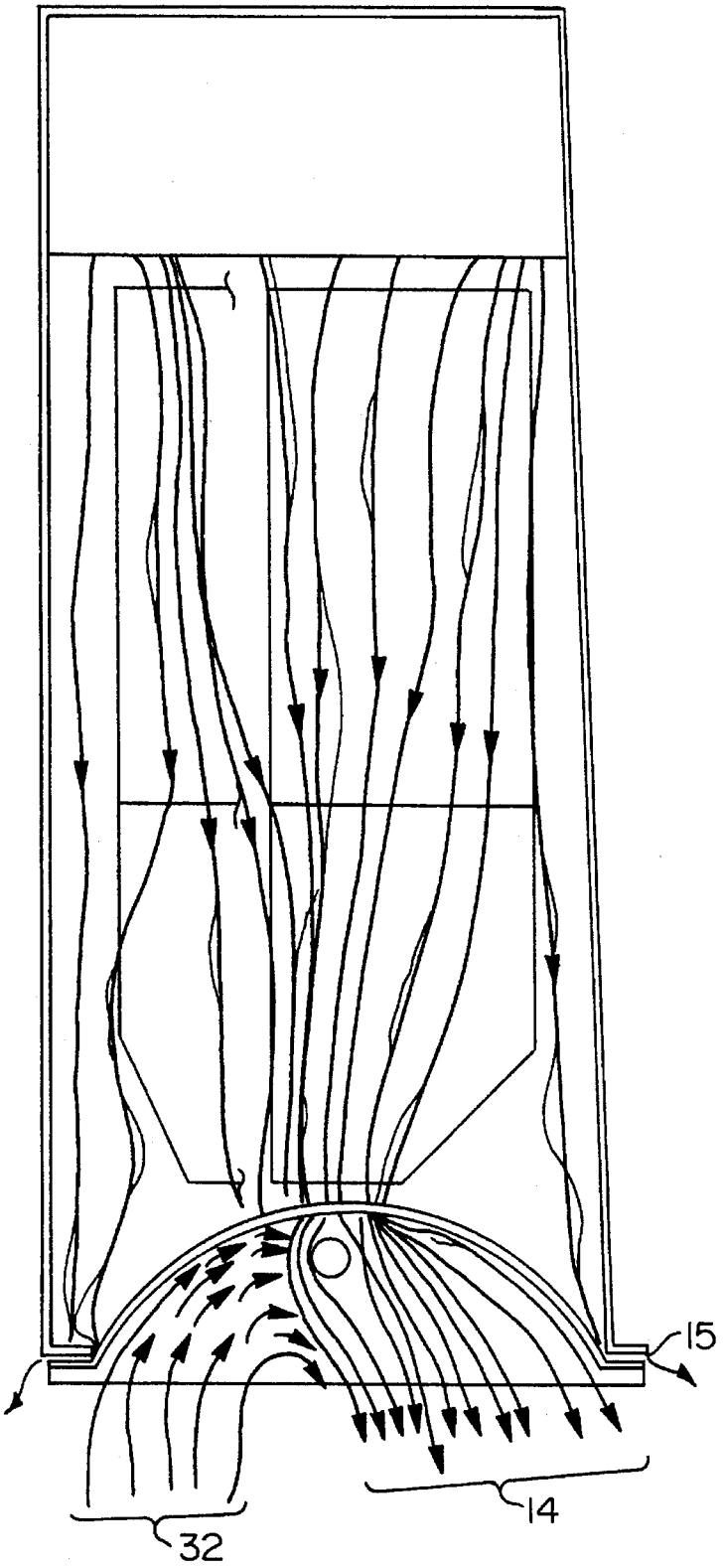
FIG. 5 PRIOR ART
FIG. 5 shows flow patterns caused by the cooling gas used in the lamp of FIG. 1.

Referring to FIG. 5, the air flow pattern in the lamp with emphasis on the pattern in the enclosure formed by the elliptic reflector and the mesh is shown schematically. This pattern was discovered using laser light sheet flow visualization techniques. It was discovered that the air leaving the cooling holes 22 flows out through one half of the wire mesh shown as stream 14. A small portion of the air leaks through the gap 15 in the mounting plates as shown. In the embodiment illustrated, this is the gap between the exterior housing and the reflector. Air from outside including contaminants such as dust particles and products of the processes accomplished by the light source enters the lamp enclosure from the other half as shown by stream 32. Based on the principles of fluid mechanics, such patterns are inevitably caused due to shear forces generated by high speed air streams entering a large cavity through relatively small openings concentrated in one region. As the air streams move further from the holes in the reflector, they spread out and entrain more air in the enclosure with them through shear forces or friction, therefore removing air from the enclosure and causing low pressure areas. Air which hits the substrate being cured is reflected back and may be drawn into these low pressure areas within the lamp enclosure. This "reverse flow" is shown by the reference numeral 32, and leads to fouling of the lamp enclosure surfaces. The location and extent of the reverse flow is very sensitive to the specific boundary and initial conditions of the flows, and slight disturbances alter the location of the reverse flow during operation.

In accordance with the method and apparatus of the present invention, a source of clean air is provided to replace the air which is entrained by the above-mentioned shear forces, thus eliminating the low pressure areas presented to the contaminants, so as to prevent the reverse flows from being drawn thereto.

Figure 6:
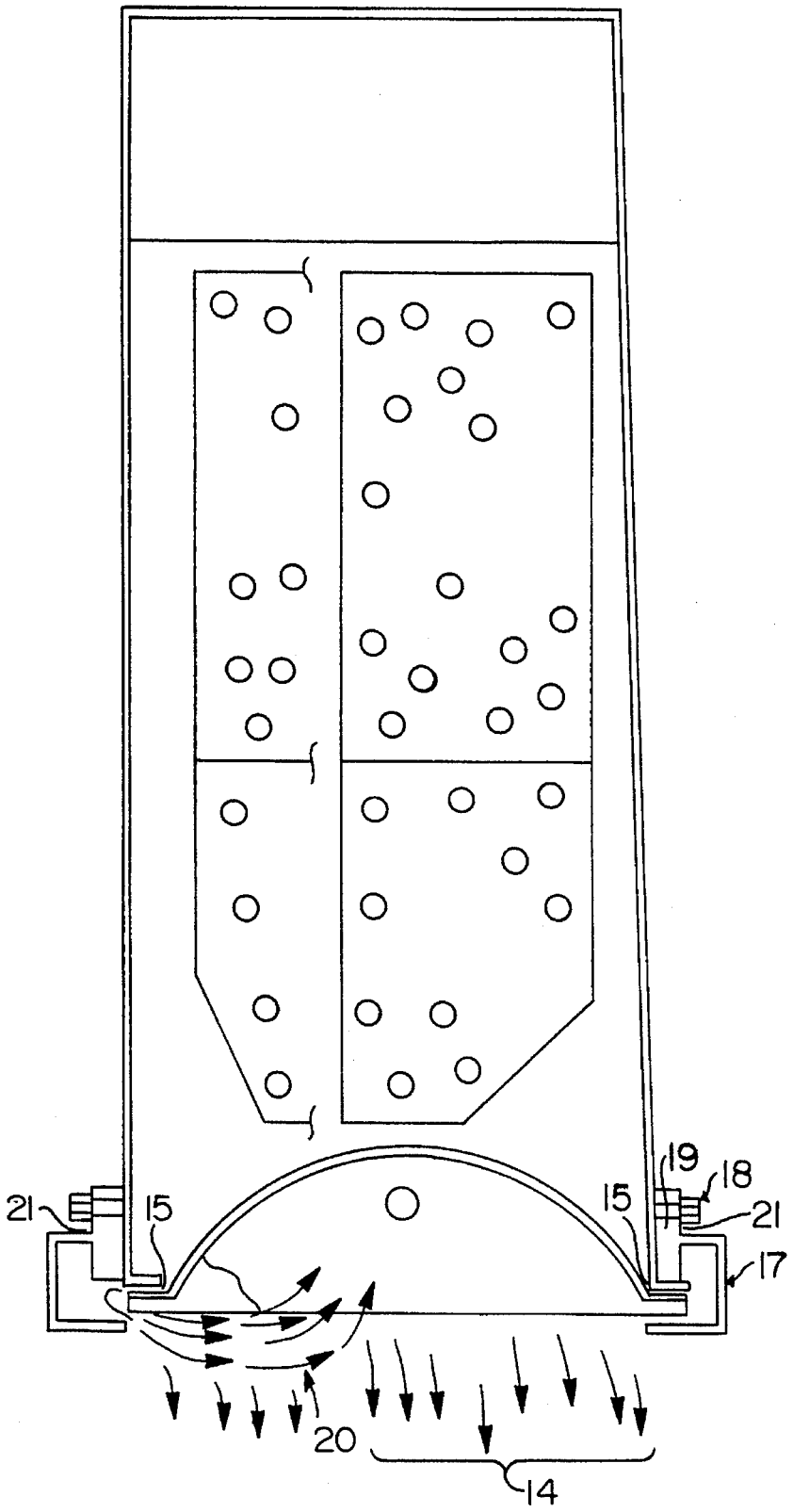
FIG. 6 shows an embodiment of the present invention along with the improved flow patterns which are created by its use.

FIG. 6 is an embodiment of the present invention as applied to the electrodeless lamp described in the above-mentioned U.S. Pat. No. 4,042,850. In FIG. 6, parts identical to those found in preceding figures are identified by corresponding reference numerals. Referring to FIG. 6, a guide or air deflector 17 is provided mounted on the cabinet. In the embodiment shown, the air deflector is a U-shaped member which is suspended from a mounting member 21 which is secured to the cabinet by sheet metal fasteners 18. Additionally, a flexible member 19 such as a gasket is included to seal the interface of the deflector and the mounting member. In accordance with the invention, the air deflector 17 redirects the air flowing through gap 15 to create a flow of replacement air 20, which replaces the air entrained by the cooling streams, thus obviating the reverse flows of contaminants.

It is noted that the air shield may be designed to cover the entire length of the screen since the location of the reverse flow is highly unstable. With proper adjustment, the damaging reverse flows can be completely eliminated and the contaminants turned back from entering the lamp enclosure.

Figure 7:
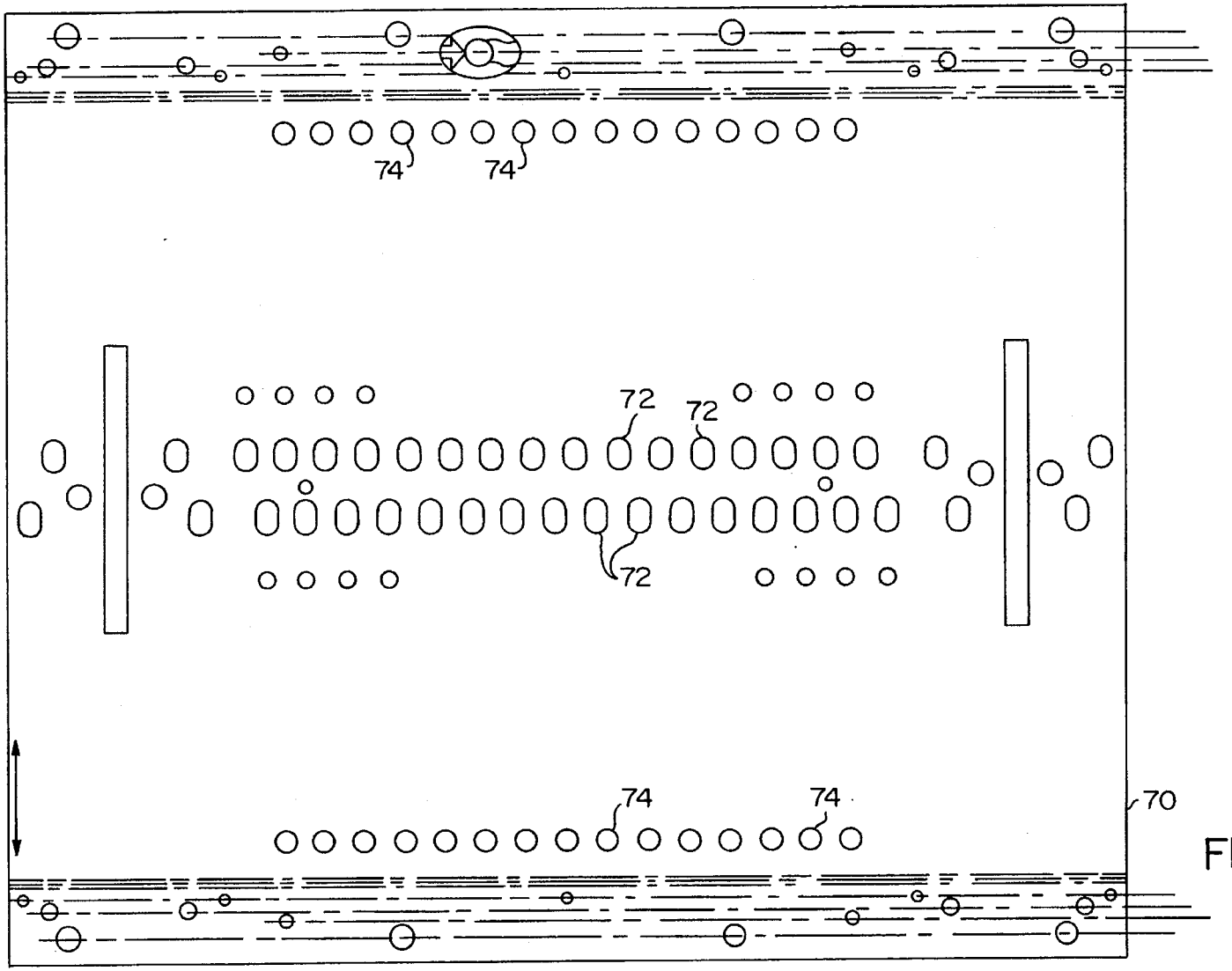
FIG. 7 shows a further embodiment of the invention.

A further embodiment of the invention is shown in FIG. 7, which depicts a novel hole pattern in reflector 70. In this embodiment, reflector 70 would be used instead of reflector 1 which is shown in FIGS. 1 and 4. As may be seen, rows of holes 72 are located near the center of the reflector and perform the same function as holes 22 in FIG. 4, i.e., the cooling fluid is emitted through these holes to cool the bulb. However, rows of holes 74, which are located near the ends of the reflector are particular to this embodiment.

The clean replacement air or gas for replacing air which is entrained by the streams flowing through holes 72 is provided by holes 74. Thus, referring to FIG. 6, the embodiment being described would not include deflectors 17, nor a significant gap 15, since the replacement air is provided by holes 74. The replacement air emitted through holes 74 in the reflector is drawn upwardly in the same manner as flow 20 in FIG. 6 to replace the entrained air. In the particular embodiment depicted, the quantity of replacement air is about ⅓ of the air mass which includes cooling air and replacement air.

In the particular embodiment shown in FIG. 7, the shaded holes 72 are slightly larger than the unshaded holes 72.

As noted above, the flows are sensitive to initial and boundary conditions. For example, the flows may spontaneously switch from the mode shown in FIG. 6, where the flow into the lamp as at the left side (or top if the lamp is mounted on its side), and the flow out is on the right side to a mode where the flow-in is on both sides and the flow-out is in the middle.

Additionally, the apparatus may be designed so that the location of the replacement air flow may be switched depending on the location of the reverse flow. For example, if the reverse flow switches from the left side of the enclosure to the right, then in FIG. 6, shutter means may be provided for completely blocking the gap 15 on the left, while opening the gap 15 on the right.

It should be understood that a great variety of sources of air or gas, and paths which the replacement air or gas may follow are possible to accomplish the result which is attained by the invention, as are various mechanical implementations of air directing and deflecting means.

Additionally, it should be understood that while the invention has been illustrated in connection with a preferred embodiment which utilizes an electrodeless lamp of linear configuration, it may also be applied to electrodeless lamps of different configurations, e.g., spherical, toroidal, etc. Also, it may be applied to r.f. excited lamps as well as any other type of lamp which is cooled by a stream of cooling air or gas.

Therefore, while the invention has been illustrated in connection with specific embodiments, it should be understood that variations will occur to those skilled in the art, and the invention is to be limited only by the claims which are appended hereto and equivalents.

We claim:

1. A microwave powered lamp in which reverse flows of cooling air or gas are prevented, comprising, a bulb containing a plasma forming medium, a microwave cavity comprised of a reflector and mesh in which said bulb is located, said reflector having a set of openings, means for providing air or gas under pressure, at least part of which is fed through said set of reflector openings, said air or gas after being fed through said openings being used for cooling and comprising respective streams which entrain air or gas, means for providing a source of clean air or gas, and means for causing said clean air or gas provided by said source to replace the air or gas which is entrained by said streams in sufficient amount to prevent said reverse flows from occurring.

2. The lamp of claim 1 wherein said means for providing a source of clean air or gas includes said means for providing air or gas under pressure and a second set of reflector openings, said set of openings being near the center of the reflector and said second set of reflector openings being near the ends of the reflector.

3. The lamp of claim 2 wherein said bulb is of linear configuration.

4. The lamp of claim 1 wherein said microwave cavity is disposed in a housing and wherein said means for providing a source of clean air or gas includes said means for providing cooling air or gas under pressure and an opening between said housing and said microwave cavity.

5. The lamp of claim 4 wherein said bulb is of linear configuration.

6. A method of preventing reverse flows of gas towards a lamp which is cooled by at least a stream of gas under pressure, which stream of gas entrains gas as the stream flows, comprising the steps of, providing a source of clean gas, and causing said clean gas to replace the gas which is entrained by the at least stream of gas under pressure in an amount which is sufficient to prevent said reverse flows from occurring.

7. The method of claim 6 wherein said gas is air.

* * * * *